US009314802B2

(12) United States Patent
Okumura et al.

(10) Patent No.: US 9,314,802 B2
(45) Date of Patent: Apr. 19, 2016

(54) SPRAYING TUBE DEVICE AND HEAT EXCHANGER USING THE SAME

(75) Inventors: Takeshi Okumura, Kobe (JP); Naoki Miyake, Kobe (JP); Tadashi Takemura, Kobe (JP); Kyoko Takemura, legal representative, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 282 days.

(21) Appl. No.: 13/822,321

(22) PCT Filed: Sep. 13, 2010

(86) PCT No.: PCT/JP2010/005567

§ 371 (c)(1),
(2), (4) Date: Apr. 11, 2013

(87) PCT Pub. No.: WO2012/035571

PCT Pub. Date: Mar. 22, 2012

(65) Prior Publication Data

US 2013/0220578 A1 Aug. 29, 2013

(51) Int. Cl.
*F28D 3/04* (2006.01)
*B05B 1/26* (2006.01)
(Continued)

(52) U.S. Cl.
CPC ..... *B05B 1/265* (2013.01); *F25B 39/028* (2013.01); *F28D 3/02* (2013.01); *F28D 3/04* (2013.01); *B05B 7/0012* (2013.01)

(58) Field of Classification Search
CPC ..... F28D 5/02; F28D 3/00; F28D 3/02; F28D 3/04; F28D 3/06; F28F 25/02; F25B 39/02; B05B 1/044
USPC ..... 165/110, 115–117; 62/259.4, 515; 239/193; 261/112.1
See application file for complete search history.

(56) References Cited

U.S. PATENT DOCUMENTS 33,967 A * 12/1861 Trageser ..... 165/115
1,546,841 A * 7/1925 Kuhn ..... 239/193
(Continued)

FOREIGN PATENT DOCUMENTS

CN 1128331 C 11/2003
DE 910307 * 4/1954
(Continued)

OTHER PUBLICATIONS

Hartig, 910307TRANS (English Translation), Apr. 1954.*
(Continued)

*Primary Examiner* — M. Alexandra Elve
*Assistant Examiner* — Eric Ruppert
(74) *Attorney, Agent, or Firm* — Oliff PLC

(57) ABSTRACT

Disclosed is a spraying tube device capable of, even in a case where a spray solution having low latent heat is used in a falling film type evaporator, uniformly spraying the spray solution to a heat-transfer tube, and a heat exchanger using the spraying tube device. The spraying tube device includes: a spraying tube configured to eject a spray solution M upward through ejection holes arranged along a tube axis C; a cover arranged above the spraying tube and configured to receive the ejected spray solution M and cause the spray solution M to flow through a space S between the cover and the spraying tube to flow downward on an outer surface of the spraying tube, and fins configured to uniformize in a tube axis C direction a distribution of the spray solution M having flowed downward from the cover.

17 Claims, 10 Drawing Sheets

(51) Int. Cl.

| | |
|---|---|
| ***F28D 3/02*** | (2006.01) |
| ***F25B 39/02*** | (2006.01) |
| *B05B 7/00* | (2006.01) |

(56) References Cited

U.S. PATENT DOCUMENTS

| | | | | | |
|---|---|---|---|---|---|
| 1,607,611 | A | * | 11/1926 | Feldmeier | 165/117 |
| 3,146,609 | A | * | 9/1964 | Engalitcheff, Jr. | 62/305 |
| 4,440,216 | A | * | 4/1984 | Conti | 165/117 |
| 4,479,909 | A | * | 10/1984 | Streuber | 261/97 |
| 5,588,596 | A | * | 12/1996 | Hartfield et al. | 239/542 |

FOREIGN PATENT DOCUMENTS

| | | | |
|---|---|---|---|
| JP | A-51-51039 | | 5/1976 |
| JP | A-51-51040 | | 5/1976 |
| JP | U-53-116059 | | 9/1978 |
| JP | U-58-55262 | | 4/1983 |
| JP | A-5-172438 | | 7/1993 |
| JP | A-8-189726 | | 7/1996 |
| JP | A-10-267463 | | 10/1998 |
| JP | A-10-332225 | | 12/1998 |
| JP | 2005003296 | * | 1/2005 |
| JP | A-2005-207621 | | 8/2005 |
| JP | A-2005-241204 | | 9/2005 |
| SU | 474344 | * | 11/1975 |
| WO | WO 98/26239 A1 | | 6/1998 |

OTHER PUBLICATIONS

Fukuzumi, JP2005003296TRANS (English Translation), Jan. 2005.*

Vashuk, SU474344TRANS (English Translation), Nov. 1975.*

Translation of Oct. 5, 2010 International Search Report issued in International Patent Application No. PCT/JP2010/005567.

* cited by examiner

SPRAYING TUBE DEVICE AND HEAT EXCHANGER USING THE SAME

TECHNICAL FIELD

The present invention relates to a spraying tube device used in a heat exchanger, such as a falling film type evaporator, and a heat exchanger using the spraying tube device.

BACKGROUND ART

The boiling point of a working medium of a binary turbine using low-temperature exhaust heat as a heat source needs to be a low temperature. Therefore, used as the working medium is not water but freon, alternative freon, or the like having a low boiling point. However, since such a low boiling point gas is expensive, there is a demand to reduce a holding gas amount as much as possible. Here, it is thought that a falling film type evaporator used in an absorption refrigerating machine and having a high heat-exchange efficiency is adopted as the evaporator of the binary turbine (for example, PTL 1).

CITATION LIST

Patent Literature

PTL 1: Japanese Laid-Open Patent Application Publication No. 51-51040

FIGS. 9 and 10 each shows a spraying tube device of the evaporator in PTL 1. As shown in FIG. 9, a spray solution M ejected upward through ejection holes 102 formed at an upper portion of a spraying tube 101 bounces back by a cover 103 to flow out through slits 104 of the cover 103. Then, the spray solution M flows on the surface of the spraying tube 101 to flow along and fall from lower fins 105. The ejection holes 102 are formed at the upper portion of the spraying tube 101 to avoid hole clogging, which is caused by foreign matters and tends to occur in a case where the ejection holes 102 are formed at a lower portion of the spraying tube 101. As shown in FIG. 10, the fins 105 are lined up in four rows arranged in a direction perpendicular to a tube axis of the spraying tube 101, and heat-transfer tubes 106 are respectively arranged immediately below the four rows of the fins 105. Respective flow rates of the spray solution M falling from the four rows of the fins 105 are set to be equal to one another.

SUMMARY OF INVENTION

Technical Problem

Evaporative latent heat of hydro fluoro ether (HFE)-7000 that is one example of the alternative freon is 113.8 kJ/kg, that is, is extremely lower than that of water whose evaporative latent heat is 2,489 kJ/kg. Therefore, the amount of evaporation of the HFE-7000 is large, and the necessary amount of liquid supplied to the spraying tube is 13.7 times larger in mass than water and 11.1 times larger in volume than water. On this account, in a case where, for example, freon having the low latent heat is used as the spray solution of the spraying tube device in PTL 1, the flow rate becomes high, so that the following problems occur.

(1) After the spray solution ejected from the ejection holes 102 contacts the cover 103, the spray solution does not flow on the surface of the spraying tube 101 due to the high flow rate but scatters through the narrow slits 104.

(2) Since each pitch distance between the fins 105 along a longitudinal direction of the spraying tube 101 is long, the spray solution flows on the heat-transfer tubes 106 in the form of a waterfall-like line when the flow rate is high, so that the spray solution is not uniformly sprayed onto the surfaces of the heat-transfer tubes 106. In a case where the spray solution is not uniformly sprayed onto the heat-transfer tubes 106, the heat-exchange efficiency deteriorates, and the vaporization of the spray solution is not accelerated.

The present invention was made to solve the above problems, and an object of the present invention is to provide a spraying tube device capable of, even in the case of using a spray solution, such as freon, having low evaporative latent heat in a falling film type evaporator, uniformly spraying the spray solution onto heat-transfer tubes, and a heat exchanger using this spraying tube device.

Solution to Problem

To achieve the above object, a spraying tube device according to the present invention includes: a spraying tube configured to eject a spray solution upward through ejection holes arranged along a tube axis; a cover arranged above the spraying tube and configured to receive the ejected spray solution and cause the spray solution to flow through a space between the cover and the spraying tube to flow downward on an outer surface of the spraying tube; and a uniformizing structure configured to uniformize in a tube axis direction a distribution of the spray solution having flowed downward from the cover, wherein: the cover has an inverted U-shaped cross section perpendicular to a longitudinal direction along the tube axis and includes cutout portions and nail portions, the cutout portions being each formed by cutting out the cover upward from a lower end edge of each of both side walls of the cover and being arranged at a predetermined pitch along the longitudinal direction, the nail portions being each formed between the adjacent cutout portions; and a width of each of the cutout portions along the longitudinal direction at the lower end edge of each of the side walls is larger than a width of each of the nail portions. It is preferable that the width of the cutout portion at the lower end edge be two to six times the width of the nail portion.

This configuration includes the uniformizing structure configured to uniformize in the tube axis direction the distribution of the spray solution flowing downward on the outer surface of the spraying tube. Therefore, even if the amount of spray solution is large, the medium can be sprayed uniformly. In addition, since the width of the cutout portion is set to be larger than the width of the nail portion, the spray solution is prevented from scattering through the cutout portions to the outside, and the spray solution flows along the nail portions to flow downward to the spraying tube in the form of rain drops. At this time, since the width of the cutout portion is large, the pitch distance of the nail portions also becomes large. Therefore, the liquid droplets from the adjacent nail portions can be prevented from contacting each other and flowing downward in the form of a waterfall-line line.

In the present invention, it is preferable that: the cutout portion gradually increase in width as it extends downward; and a depth of the cutout portion in a direction perpendicular to the lower end edge be 0.5 to 1.2 times the width of the cutout portion at the lower end edge. According to this configuration, since the depth of the cutout portion is adequately secured, it becomes easy to gather the medium at the tip ends of the nail portions to form the liquid droplets.

In the present invention, it is preferable that the uniformizing structure be arranged at a lower portion of the spraying tube and include a plurality of fins arranged along the tube axis direction and facing downward. According to this configuration, the spray solution having flowed downward on the outer surface of the spraying tube flows along the fins arranged along the tube axis direction to fall from the fins such that the adjacent droplets are spaced apart from each other by an appropriate interval in the tube axis direction. For example, in a case where the heat-transfer tube is arranged under the spraying tube, and the medium is sprayed to the heat-transfer tube, the medium easily spreads on the heat-transfer tube in the tube axis direction by spraying the medium as liquid droplets, not as a liquid sheet. In a case where the fins are included, the liquid droplets of the spray solution is sprayed from the tip ends of the fins in the form of rain drops, so that the spray solution spreads on the heat-transfer tube in the tube axis direction. Thus, the heat-exchange efficiency improves.

Further, it is preferable that: the fins be lined up in two rows parallel to the tube axis direction; and one row of the fins and the other row of the fins be shifted from each other by a half pitch along the tube axis direction. According to this configuration, the flow rate of the spray solution flowing along one row of the fins is a half of the entire flow rate, and the phases of the two rows are shifted from each other. Therefore, in a case where the spray solution is sprayed from the two rows of the fins onto the single heat-transfer tube, the concentration of the spray solution can be prevented, and the spray solution can be stably, uniformly sprayed to the heat-transfer tube.

In the present invention, the uniformizing structure may be a spreading pipe arranged at a lower portion of the spraying tube in parallel with the spraying tube and including depressions and projections on a surface of the spreading pipe, the depressions and projections causing the spray solution to spread in a direction parallel to the tube axis direction. According to this configuration, since the spreading pipe is just attached, the manufacturing is easy.

The uniformizing structure may be constituted by a depression-projection portion formed on a surface of the spraying tube and configured to cause the spray solution to spread in a direction parallel to the tube axis direction. According to this configuration, since a separate uniformizing structure becomes unnecessary, the number of parts can be reduced.

A heat exchanger according to the present invention includes: the spraying tube device of the present invention; and a heat-transfer tube having an outer surface configured to receive the spray solution dropped from the uniformizing structure, the heat-transfer tube being configured to perform heat exchange between the spray solution and another fluid flowing through an inside of the heat-transfer tube. According to this configuration, even in the case of using a medium, such as freon, having low latent heat, the heat-exchange efficiency can be improved by uniformly spraying the medium to the heat-transfer tube.

Another heat exchanger according to the present invention includes: the spraying tube device according to claim 5; and a single heat-transfer tube having an outer surface configured to receive the spray solution dropped from the fins lined up in two rows, the single heat-transfer tube being configured to perform heat exchange between the spray solution and another fluid flowing through an inside of the single heat-transfer tube. According to this configuration, the spray solution can be stably, uniformly sprayed to the heat-transfer tube by spraying the solution from the fins lined up in two rows, not one row.

Advantageous Effects of Invention

The spraying tube device or heat exchanger of the present invention includes the uniformizing structure configured to uniformize in the tube axis direction the distribution of the spray solution flowing downward on the outer surface of the spraying tube. Therefore, even if the amount of spray solution is large, the medium can be uniformly sprayed. In addition, since the width of the cutout portion is set to be larger than the width of the nail portion, the spray solution is prevented from scattering through the cutout portions to the outside, and the spray solution flows along the nail portions to flow downward to the spraying tube in the form of rain drops. At this time, since the width of the cutout portion is large, the pitch distance of the nail portions also becomes large. Therefore, the liquid droplets from the adjacent nail portions are prevented from contacting each other and flowing downward in the form of a waterfall-like line, and the solution can adequately spread on the spraying tube.

DESCRIPTION OF EMBODIMENTS

Figure 1:
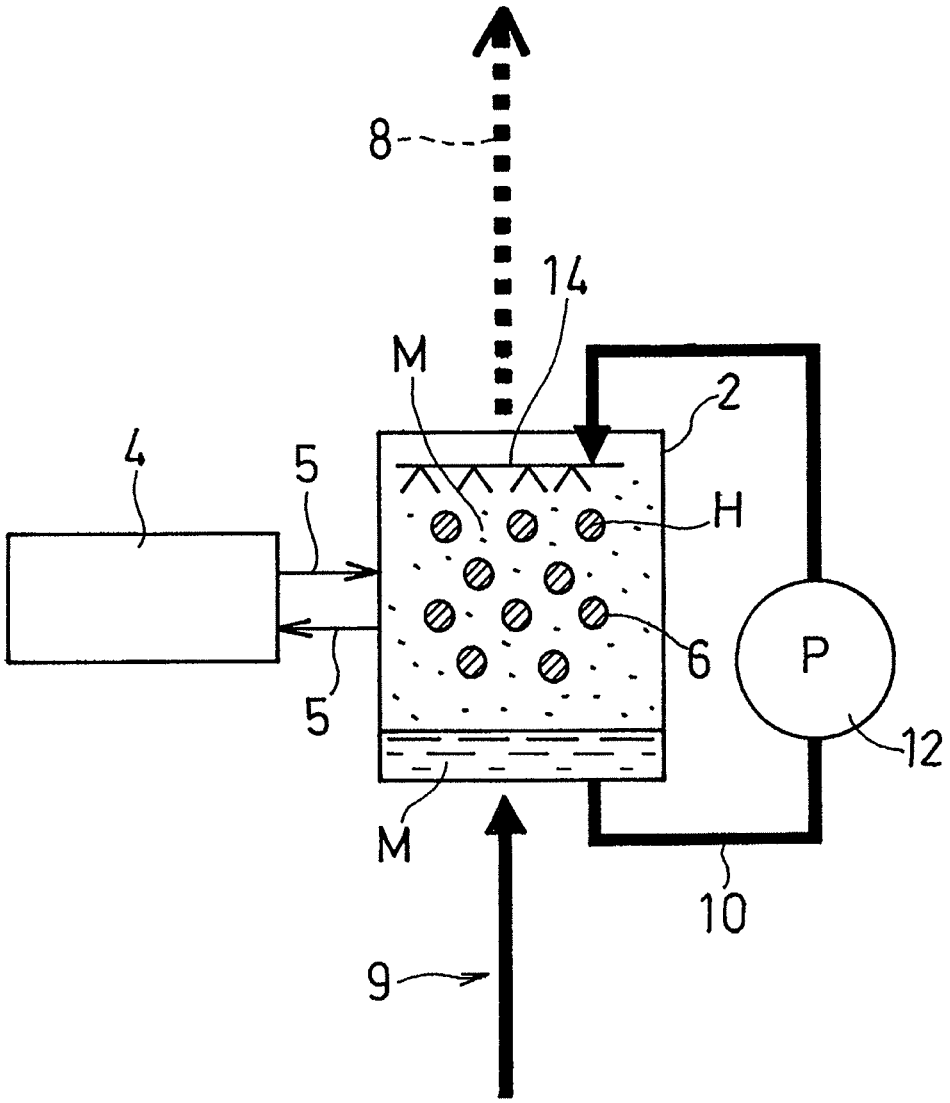
FIG. 1 is a system diagram showing an evaporator that is one type of heat exchanger using a spraying tube device according to Embodiment 1 of the present invention.

Hereinafter, preferred embodiments of the present invention will be explained in reference to the drawings. FIG. 1 shows an evaporator 2 that is one type of heat exchanger according to Embodiment 1 of the present invention. The evaporator 2 is used for a binary turbine configured to use as a heat source 4 hot water generated in an iron mill, a ceramic industry, or the like and use a low boiling point material as a working medium M. Hot water H is supplied from the heat source 4 through a pipe 5 to the evaporator 2. The working medium M is vaporized by heat exchange with the hot water H flowing through heat-transfer tubes 6 in the evaporator 2, that is, heat exchange with the heat source 4. The gas-phase working medium M is supplied through a gas-phase medium supply passage 8 to the binary turbine of a power generating unit, not shown. The gas-phase working medium M discharged from the binary turbine flows through a condenser, not shown, to become a liquid phase. Then, the liquid-phase working medium M returns to the evaporator 2 through a liquid-phase medium recovery passage 9.

A circulation passage 10 arranged to realize communication between a lower portion and upper portion of the evaporator 2 is connected to the evaporator 2, and a circulating pump 12 is provided on the circulation passage 10. By the circulating pump 12, the liquid-phase working medium M taken out from the lower portion of the evaporator 2 is supplied to a spraying tube device 14 arranged at the upper portion in the evaporator 2. The spraying tube device 14 sprays the working medium M to the inside of the evaporator 2 to apply it to outer surfaces of the heat-transfer tubes 6. With this, the heat exchange is accelerated between the hot water H flowing in the heat-transfer tubes 6 and the working medium M. The working medium M is a medium, such as hydro fluoro ether (HFE), having a lower boiling point than water.

Figure 2:
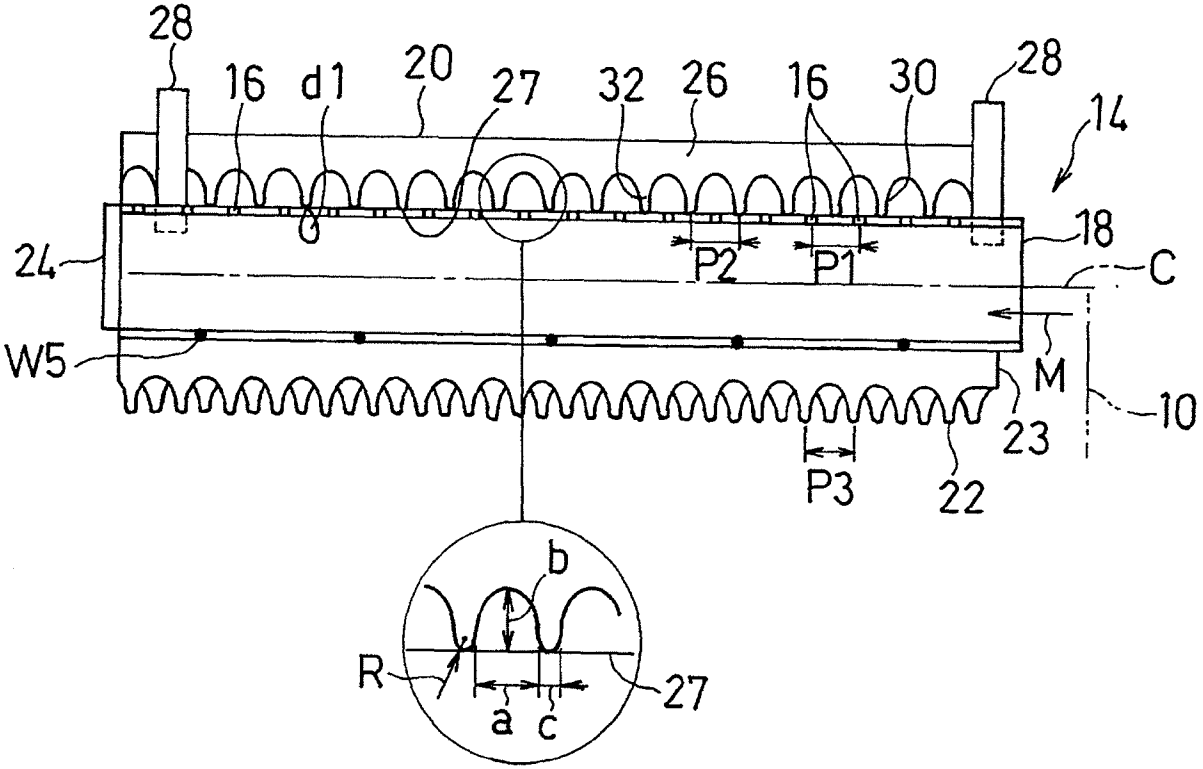
FIG. 2 is a side view showing a partial cross section of the spraying tube device.

As shown in FIG. 2, the spraying tube device 14 includes: a spraying tube 18 configured to eject the working medium M that is a spray solution upward through a plurality of ejection holes 16 arranged along a tube axis C; a cover 20 arranged above the spraying tube 18; and a uniformizing structure 22 arranged at a lower portion of the spraying tube 18.

The spraying tube 18 is a cylindrical pipe, which is seamless, not subjected to a surface treatment, and made of steel. One end (right end) of the spraying tube 18 is connected to the circulation passage 10 (FIG. 1), and the other end thereof is closed by a closing member 24. For example, the spraying tube 18 has an inner diameter of about 25 mm and a thickness of about 2 mm.

The ejection holes 16 are through holes provided at an upper portion of the spraying tube 18 and arranged at a constant hole pitch P1 in a tube axis C direction. Since the spray solution M is ejected upward through the ejection holes 16, foreign matters inside or outside the spraying tube 18 do not clog in the ejection holes 16. If the hole diameter of each ejection hole 16 is too small, foreign matters may clog, or the hole diameters may vary relatively significantly depending on the processing accuracy. Therefore, it is desirable that the hole diameter of each ejection hole 16 be 1 mm or more. However, as shown in Table 1, if the hole diameter is large, pressure loss at the ejection holes 16 becomes small, so that the amounts of ejection from respective ejection holes 16 are easily influenced by pressure gradient from the vicinity of an inlet port (right end) of the spraying tube 18 toward the tube axis C direction and the inclination of the spraying tube 18. Thus, the amounts of ejection from respective ejection holes 16 vary. In addition, if the hole diameter is large, an ejection speed becomes low. With this, an ejection height becomes low. Therefore, the spray solution M does not contact an upper wall of the cover 20. In addition, if the directions of the ejection holes 16 are inclined from the vertical direction, the spray solution M does not further contact the cover 20. On this account, in the present embodiment, the hole diameter is set to 1 mm, by which the foreign matters do not clog, and the amounts of ejection are uniform in the tube axis C direction.

TABLE 1

| Hole Diameter (mm) | Hole Pitch (mm) | Ejection Speed (m/s) | Ejection Height (mm) |
|---|---|---|---|
| 0.5 | 10 | 6.3 | 2,018 |
| 0.7 | 10 | 3.2 | 525 |
| 1.0 | 10 | 1.6 | 126 |
| 1.5 | 10 | 0.7 | 25 |
| 2.0 | 10 | 0.4 | 8 |

To reduce the manufacturing steps, it is desirable to widen the hole pitch P1 of the ejection holes 16. However, if the hole pitch P1 is large, the distribution of the spray solution M ejected from the spraying tube 18 scatters in the tube axis C direction, so that it is impossible to uniformly wet the heat-transfer tubes 6 with the spray solution M. To uniformly wet the heat-transfer tubes 6 while maintaining the processability, it is desirable that the hole pitch P1 of the ejection holes 16 be set to 5 to 10 mm. In the present embodiment, the hole pitch P1 is set to 10 mm, by which the manufacturing steps can be reduced.

Figure 3:
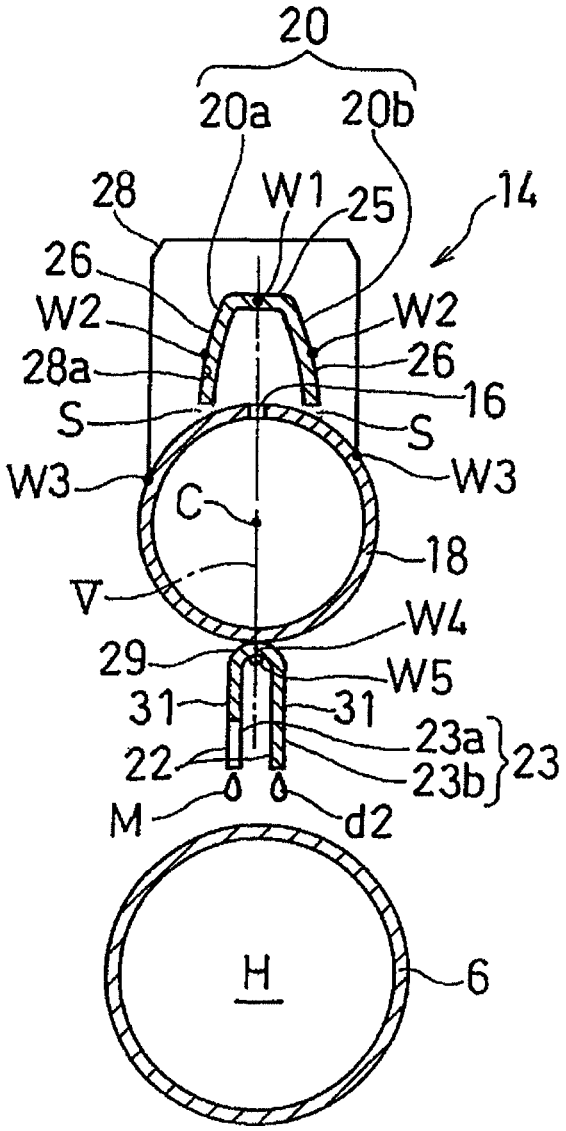
FIG. 3 is a cross-sectional view of the spraying tube device.

The cover 20 is supported above the spraying tube 18 by a plurality of cover supports 28 so as not to contact an outer surface of the spraying tube 18, the plurality of cover supports 28 being fixed to the upper portion of the spraying tube 18 and arranged in the tube axis C direction. The cover 20 is formed by a stainless steel plate. As shown in FIG. 3, the cover 20 has an inverted U-shaped cross section perpendicular to a longitudinal direction along the tube axis C. The cover 20 includes an upper wall 25 and side walls 26 respectively extending downward from both sides of the upper wall 25. A space S between the cover 20 and the spraying tube 18 is about 1.7 to 2 mm. As shown in FIG. 2, on both side walls 26 of the cover 20, cutout portions 30 each formed by cutting out the side wall 26 upward from a lower end edge 27 are formed at a predetermined pitch along the longitudinal direction. Each of nail portions 32 is formed between the adjacent cutout portions 30. In this example, a pitch of the cutout portions 30 is equal to the hole pitch P1, and the positions of the cutout portions 30 in the tube axis C direction and the positions of the ejection holes 16 in the tube axis C direction are set to be the same as each other.

The cover 20 shown in FIG. 3 includes a cover left half body 20*a* and a cover right half body 20*b*, which are symmetrical in a left-right direction about a vertical plane V passing through the tube axis C. The cover left half body 20*a* and the cover right half body 20*b* are joined to each other on the vertical plane V.

Each cutout portion 30 shown in FIG. 2 has a smooth curved line shape, which gradually increases in width as it extends downward. In the present embodiment, each cutout portion 30 has a semicircular shape. However, the present embodiment is not limited to the semicircular shape, and the shape of each cutout portion 30 may be a semielliptical shape, a triangular shape, or the like. A width a of the cutout portion 30 along the longitudinal direction C at the lower end edge 27 of each of the side walls 26 of the cover 20 is larger than a width c of each nail portion 32. A tip end portion of the nail portion 32 has a round shape having a radius R but does not have to have this round shape. In a case where the pitch P2 of the nail portions 32 is narrow, the spray solution M can be uniformly sprayed in the tube axis C direction. However, if the nail pitch P2 is too narrow, liquid droplets d1 of the adjacent nail portions 32 are unified to flow down in the form of a line. Therefore, it becomes difficult for the spray solution M to spread in the tube axis C direction on the outer surface of the spraying tube 18. In a case where the flow of the spray solution M on the outer surface of the spraying tube 18 is nonuniform in the tube axis C direction, the spraying of the spray solution M to the heat-transfer tube 6 located under the spraying tube 18 also becomes nonuniform. Therefore, it is preferable that the nail pitch P2 be 5 to 20 mm. In the present embodiment, the nail pitch P2 is set to 10 mm. If the nail pitch P2 is shorter than 5 mm, the liquid droplets d1 of the adjacent nail portions 32 are unified to form the line-shaped flow. If the nail pitch P2 is longer than 20 mm, the liquid droplets d1 are separated too much from each other in the tube axis C direction to form nonuniform flow in the tube axis C direction.

To prevent the liquid droplets d1 of the adjacent nail portions 32 from being unified, it is preferable that the width of the liquid droplet d1 be not too large. Therefore, it is preferable that the width c of the tip end portion of the nail portion 32 be also small, that is, 1 mm or less. In view of the processability, it is not preferable that the width c be extremely small.

Therefore, in the present embodiment, the width c is set to 1 mm. It is preferable that the width a of the cutout portion 30 be two to six times the width c of the nail portion 32. To form the liquid droplet d1 at the tip end of the nail portion 32, it is desirable that a depth b of the cutout portion 30 in a direction perpendicular to the lower end edge 27 of the cover 20 be 0.5a to 1.2a where a denotes the width a of the cutout portion 30. It was confirmed that the liquid droplet d1 was formed at the tip end portion of the nail portion 32 when the width c was 1 mm.

The uniformizing structure 22 provided at the lower portion of the spraying tube 18 is formed by an apron 23 including fins 22 lined up in two rows. The apron 23 is formed by a stainless steel plate. As shown in FIG. 3, the apron 23 has an inverted U-shaped cross section and includes an upper wall 29 and both side walls 31 respectively extending downward from both side ends of the upper wall 29. The fins 22 are formed at both side walls 31 to extend downward. The plurality of fins 22 in each row are arranged at a constant fin pitch P3 along the tube axis C direction shown in FIG. 2. The spray solution M having flowed downward on the outer surface of the spraying tube 18 flows along respective rows of the fins 22 arranged along the tube axis C direction to fall from the fins 22 such that the adjacent droplets are spaced apart from each other by an appropriate interval in the tube axis C direction.

Each fin 22 has a mountain shape similar to the shape of the nail portion 32 of the cover 20. The fins 22 are formed at the constant fin pitch P3 in the tube axis C direction. The phases of the respective rows of the fins 22 are shifted from each other by ½ of the fin pitch P3. The fin pitch P3 is preferably 4 to 20 mm. In the present embodiment, the fin pitch P3 is set to 8 mm. If the fin pitch P3 is shorter than 4 mm, liquid droplets d2 of the adjacent fins 22 are unified to form the line-shaped flow. If the fin pitch P3 is longer than 20 mm, the liquid droplets d2 are separated too much from each other in the tube axis C direction to form the nonuniform flow in the tube axis C direction.

As shown in FIG. 3, the single heat-transfer tube 6 is arranged immediately under the fins 22 lined up in two rows. Therefore, the spray solution M dropped from the fins 22 lined up in two rows is divided to flow on both sides of the heat-transfer tube 6. The spray solution M flows downward on the outer surface of the heat-transfer tube 6, and the heat exchange between the hot water H flowing inside the heat-transfer tube 6 and the spray solution M is performed via a wall of the heat-transfer tube 6. Thus, the spray solution M is heated to evaporate. The arrangement of the fins 22 is not limited to two rows and may be one row or three rows or more. In addition, the heat-transfer tube 6 is not limited to a single tube with respect to the fins 22 lined up in two rows. One heat-transfer tube 6 may be arranged under each row of the fins 22.

Next, methods of manufacturing the cover 20 and the apron 23 will be explained.

In the manufacturing of the cover 20, first, each of two rectangular stainless steel plates is cut by punching, laser processing, or the like such that semicircular shapes are formed thereon at regular intervals. Thus, the cutout portions 30 and the nail portions 32 are formed. Next, each of the stainless steel plates is bent by bending to become a shape that is a half of the U shape. Thus, the cover left half body 20*a* and the cover right half body 20*b* are formed. Then, the cover left half body 20*a* and the cover right half body 20*b* are fixed to each other at a joint portion W1 by a joining means, such as welding. Thus, the cover 20 is formed. Each of the cover supports 28 is formed in a gate shape by casting, forging, or the like, and a gate-shaped inner surface 28*a* coincides with an outer surface of the cover 20. The cover support 28 is engaged with the cover 20 and is fixed to the cover 20 at engagement portions W2 by a fixing means, such as welding. Thus, the cover 20 is attached to the cover support 28. The cover support 28 is fixed to the spraying tube 18 at lower-end fixed portions W3 by a fixing means, such as welding.

The apron 23 is manufactured by the same method as the cover 20. To be specific, the apron 23 is formed by an apron left half body 23*a* and an apron right half body 23*b*, and the apron left half body 23*a* and the apron right half body 23*b* are formed by stainless steel plates. First, one side of each of two rectangular stainless steel plates is cut by punching, laser processing, or the like such that semicircular shapes are formed thereon at regular intervals. Thus, the fins 22 are formed. The cut shape is not limited to the semicircular shape and may be a semielliptical shape, a triangular shape, or the like. Next, each of the stainless steel plates is bent by bending to become a shape that is a half of the U shape. Then, the obtained apron left half body 23*a* and apron right half body 23*b* are fixed to each other at a fixed portion W4 by a fixing means, such as spot welding. Thus, the apron 23 is formed. The apron 23 manufactured as above is fixed to the spraying tube 18 at a fixed portion W5 by a fixing means, such as spot welding.

Figure 4:
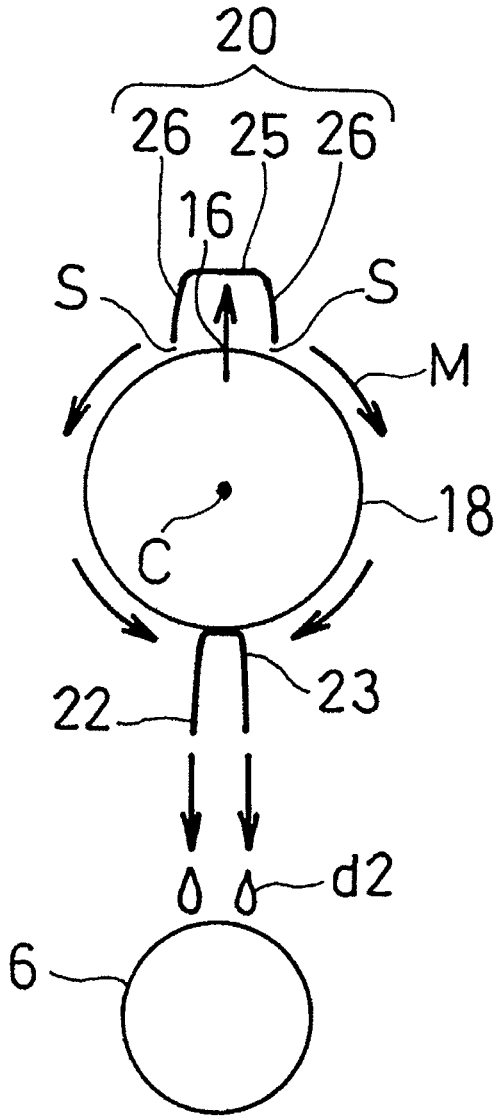
FIG. 4 is a schematic diagram showing the flow of a spray solution of the spraying tube device.

The actions of the present embodiment will be explained in reference to FIG. 4. The spray solution M pumped to the spraying tube 18 by the circulating pump 12 (FIG. 1) is ejected upward through the ejection holes 16 formed at the upper portion of the spraying tube 18. Then, the spray solution M contacts an inner surface of the upper wall 25 of the cover 20. Next, the spray solution M is equally divided to flow on both sides of the cover 20 having the inverted U shape. The spray solution M flows downward on inner surfaces of the side walls 26 to flow through the space S between the cover 20 and the spraying tube 18 and then flow downward on the outer surface of the spraying tube 18. At this time, a part of the spray solution M flows along edges of the cutout portions 30 shown in FIG. 2 and gathers at the tip ends of the nail portions 32. Thus, the spray solution M falls from the tip ends as liquid droplets, like rain drops, onto the spraying tube 18. With this, the spray solution M spreads in the tube axis C direction of the spraying tube 18 on the entire outer surface of the spraying tube 18. Here, since the spraying tube 18 is seamless and not subjected to the surface treatment, the spray solution M further effectively spread in the tube axis C direction.

The spray solution M having flowed downward to the lower portion of the spraying tube 18 flows to the apron 23 uniformly in the tube axis C direction. Then, the spray solution M gathers at the fins 22 shown in FIG. 4 to become the large liquid droplets d2, and the large liquid droplets d2 fall onto the heat-transfer tube 6 like rain drops. Here, since the spray solution M uniformly spreads on the spraying tube 18 and flows to the apron 23 in this state, the spray solution M does not locally gather on the apron 23 and form the line-shaped flow.

The above configuration includes the fins 22 configured to uniformize in the tube axis C direction the distribution of the spray solution M flowing downward on the outer surface of the spraying tube 18 shown in FIG. 2. Therefore, even if the amount of spray solution M is large, the spray solution M can be sprayed uniformly. In addition, since the width a of the cutout portion 30 is set to be larger than the width c of the nail portion 32, the spray solution M is prevented from scattering through the cutout portions 30 to the outside, and the spray solution M flows along the nail portions 32 to flow downward to the spraying tube 18 in the form of rain drops. At this time, since the width a of the cutout portion 30 is large, the pitch P2 of the nail portions 32 also becomes large. Therefore, the liquid droplets d1 from the adjacent nail portions 32 can be prevented from contacting each other and flowing downward in the form of a waterfall-like line. In addition, the spray solution M having flowed downward on the outer surface of the spraying tube 18 flows along the respective rows of the fins 22 arranged in the tube axis C direction to fall from the fins 22 such that the adjacent droplets are spaced apart from each other by an appropriate interval in the tube axis C direction. With this, even if the amount of spray solution M is large, the spray solution M can be uniformly sprayed to the heat-transfer tube 6.

Further, the cutout portion 30 gradually increases in width as it extends downward, and the depth b in a direction perpendicular to the lower end edge 27 is set to 0.5 to 1.2 times the width a at the lower end edge 27. Therefore, the depth b of the cutout portion 30 is adequately secured, and it becomes easy to gather the spray solution M at the tip ends of the nail portions 32 to form the liquid droplets d1.

The apron 23 is arranged at the lower portion of the spraying tube 18 and includes the plurality of fins 22 arranged along the tube axis C direction and facing downward. Therefore, the spray solution M having flowed downward on the outer surface of the spraying tube 18 flows along the fins 22 arranged along the tube axis C direction to fall from the fins 22 such that the adjacent droplets are spaced apart from each other by an appropriate interval in the tube axis C direction. In a state where the liquid droplets d2 of the spray solution M are spaced apart from each other by the interval in the tube axis C direction as above, the liquid droplets are sprayed to the heat-transfer tube 6 from the tip ends of the fins 22 like rain drops and spread on the heat-transfer tube 6 in the tube axis C direction. Thus, the heat-exchange efficiency improves.

Since the fins 22 are lined up in two rows parallel to the tube axis C direction, the flow rate of the spray solution M flowing along one row of the fins 22 is a half of the entire flow rate. In addition, the phases of the two rows are shifted from each other by a half pitch. Therefore, even if the amount of spray solution M is large, the concentration of the spray solution M on the single heat-transfer tube 6 can be prevented, and the spray solution M can be stably sprayed to the heat-transfer tubes 6 uniformly in the tube axis C direction.

Figure 5:
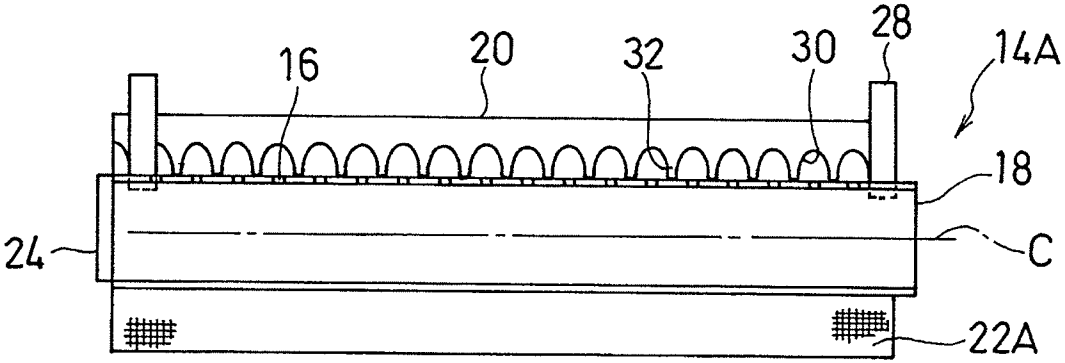
FIG. 5 is a side view of the spraying tube device according to Embodiment 2 of the present invention.

FIG. 5 shows a spraying tube device 14A according to Embodiment 2 of the present invention. The present embodiment is the same as Embodiment 1 in that the ejection holes 16 are formed at the upper portion of the spraying tube 18, and the cover 20 is provided. However, the present embodiment is different from Embodiment 1 in that as a uniformizing structure 22A, a spreading pipe 22A having a surface on which depressions and projections are formed is fixed to the lower portion of the spraying tube 18. The spreading pipe 22A is arranged parallel to the spraying tube 18.

Figure 6B:
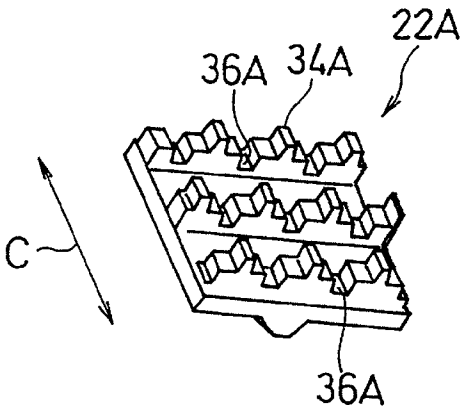
FIG. 6B is a modification example of FIG. 6A.
Figure 6A:
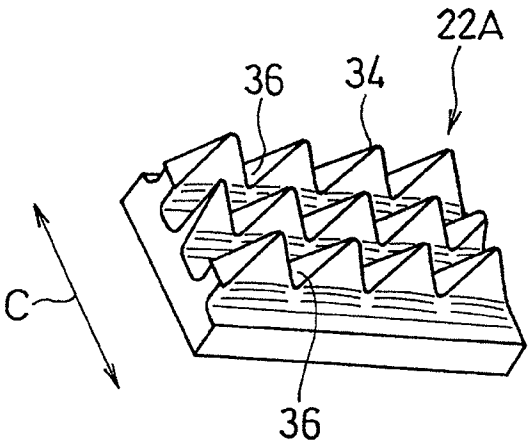
FIG. 6A is an enlarged view showing a surface of a spreading pipe in the spraying tube device.

The spreading pipe 22A is a cylindrical pipe having a smaller diameter than the spraying tube 18, and the depressions and projections shown in FIG. 6A are formed on an entire outer surface of the spreading pipe 22A. These depressions and projections have the same functions as the fins 22 of the apron 23 of Embodiment 1. To be specific, grooves 36 each formed between adjacent thin square pyramid-shaped projecting portions 34 of the spreading pipe 22A are arranged in a zigzag manner in the tube axis C direction. Therefore, the spray solution M having flowed downward on the surface of the spraying tube 18 spreads by the grooves 36 in a direction parallel to the tube axis C direction. Used as the spreading pipe 22A is a copper pipe, such as a CCS pipe, having a surface on which depressions and projections are formed. A pipe having step-like projecting portions 34A shown in FIG. 6B as the shapes of the depressions and projections may be used. In this example, grooves 36A each formed between the adjacent projecting portions 34A are arranged in the tube axis C direction.

Embodiment 2 can obtain the same effects as Embodiment 1. In addition, since one spreading pipe 22A is just attached instead of the apron 23 (FIG. 2), the spraying tube device 14A is easily manufactured.

Figure 7:
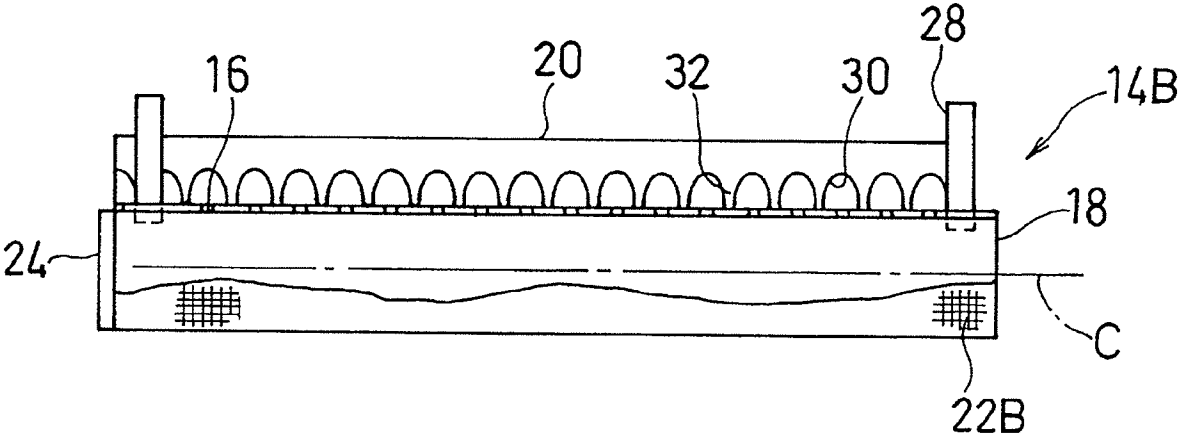
FIG. 7 is a side view of the spraying tube device according to Embodiment 3 of the present invention.

FIG. 7 is a side view of a spraying tube device 14B according to Embodiment 3 of the present invention. The present embodiment is the same as Embodiment 1 in that the ejection holes 16 are formed at the upper portion of the spraying tube 18, and the cover 20 is provided. However, the present embodiment is different from Embodiment 1 in that as a uniformizing structure 22B, a depression-projection portion 22B is formed on the surface of the spraying tube 18. Specifically, in the present embodiment, the spreading pipe 22A of Embodiment 2 is used as the spraying tube 18, and the depression-projection portion 22B is formed by depressions and projections including the grooves 36 and 36A shown in FIGS. 6A and 6B and arranged in the tube axis C direction. Therefore, the spray solution M having flowed downward on the surface of the spraying tube 18 spreads by the depression-projection portion 22B in a direction parallel to the tube axis C direction.

Embodiment 3 can obtain the same effects as Embodiments 1 and 2. In addition, since a uniformizing structure formed separately from the spraying tube 18 becomes unnecessary, the number of parts is reduced.

Visualization tests for comparing the spray state to the heat-transfer tube 6 in each of the embodiments of the present invention and the spray state to the heat-transfer tube 6 in a spraying tube device not including a uniformizing structure were performed. FIGS. 8A to 8F are simplified diagrams showing models of the tests, and Table 2 shows results of the tests.

Figure 8A:
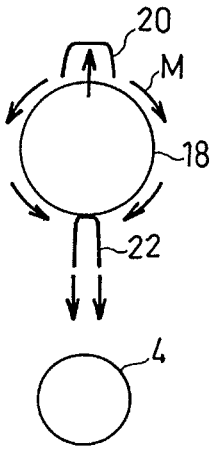
FIGS. 8A to 8F are schematic diagrams showing models of verification tests of spray states of the spraying tube devices according to respective embodiments of the present invention.
Figure 8B:
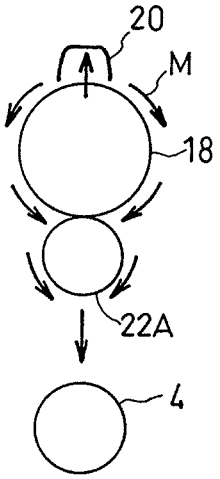
Figure 8C:
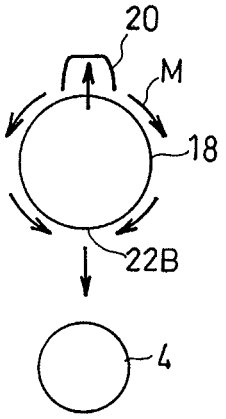
Figure 8D:
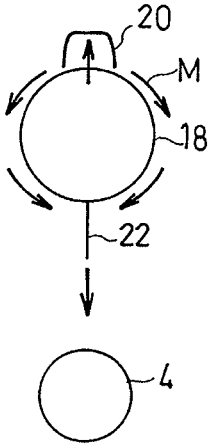
Figure 8E:
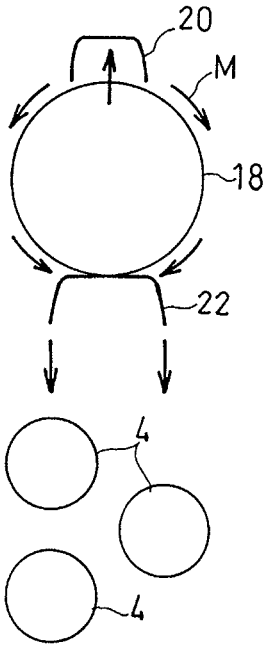
Figure 8F:
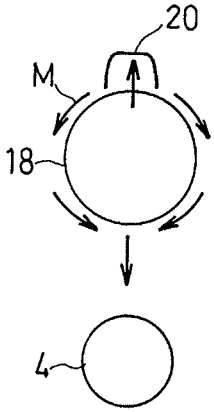
Figure 9:
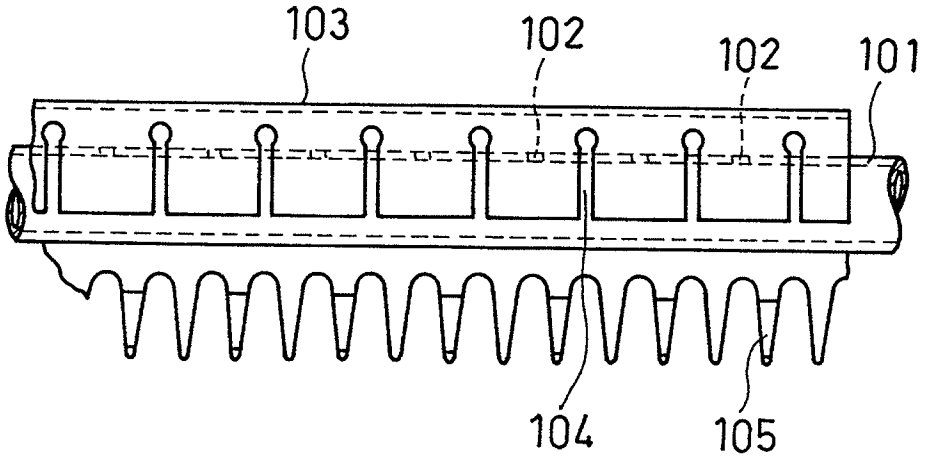
FIG. 9 is a side view of a conventional spraying tube device.
Figure 10:
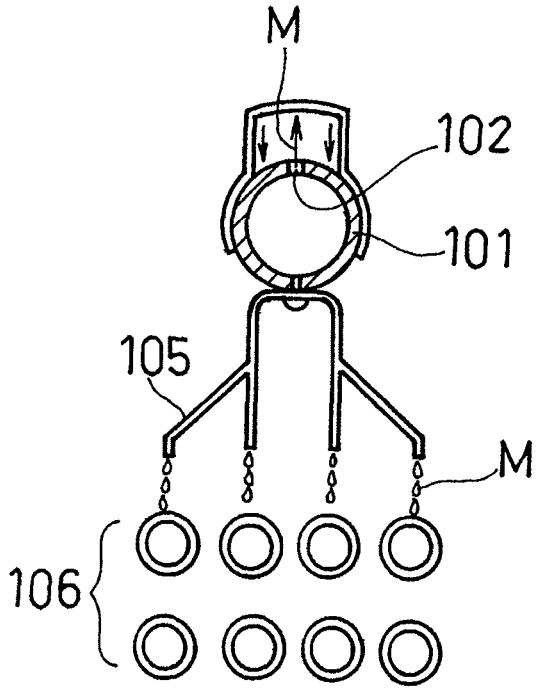
FIG. 10 is a longitudinal sectional view of the conventional spraying tube device.

The models shown in FIGS. 8A to 8C respectively correspond to the spraying tube devices 14, 14A, and 14B of Embodiments 1 to 3. The model shown in FIG. 8D corresponds to the spraying tube device 14 of Embodiment 1 except that the fins 22 are lined up in one row. The model shown in FIG. 8E corresponds to the spraying tube device 14 of Embodiment 1 except that the heat-transfer tubes 6 are respectively arranged under the rows of the fins 22. The model shown in FIG. 8F corresponds to the spraying tube device not including the uniformizing structure.

As shown in Table 2, in the model F not including the uniformizing structure, the spray solution M flowed downward in the form of a line and was not uniformly sprayed to the heat-transfer tube 6. In contrast, in the models A to C of Embodiments 1 to 3, the spray solution M flowed downward in the form of liquid droplets and was uniformly sprayed to the heat-transfer tube 6. In the models D and E, it was confirmed that the liquid solution M flowed downward in the form of substantially liquid droplets and was uniformly sprayed to the heat-transfer tube 6 to some extent.

TABLE 2

| Model | A | B | C | D | E | F |
|---|---|---|---|---|---|---|
| Evaluation | Very Good | Very Good | Very Good | Good | Good | Bad |

The foregoing has explained preferred embodiments of the present invention in reference to the drawings. However, various addition, modifications, and deletions may be made within the spirit of the present invention. Therefore, such modifications and the like are also included in the scope of the present invention.

REFERENCE SIGNS LIST

2 evaporator (heat exchanger)
6 heat-transfer tube
14, 14A, 14B spraying tube device
16 ejection hole
18 spraying tube
20 cover
25 upper wall of cover
26 side wall of cover
22 fin (uniformizing structure)
22A spreading pipe (uniformizing structure)
22B depression-projection portion (uniformizing structure)
27 lower end edge of cover
30 cutout portion
32 nail portion
a width of cutout portion
b depth of cutout portion
c width of nail portion
C tube axis
M spray solution
S space

The invention claimed is:

1. A spraying tube device comprising:
a spraying tube configured to eject a spray solution upward through a plurality of ejection holes arranged at a top most portion of the spraying tube along a tube axis;
a cover arranged above the spraying tube so as not to contact an outer surface of the spraying tube and configured to receive the ejected spray solution and cause the spray solution to flow through a space between nail portions of the cover and the spraying tube to flow downward on an outer surface of the spraying tube; and
a uniformizing structure configured to uniformize in a tube axis direction a distribution of the spray solution having flowed downward from the nail portions of the cover, wherein:
the cover has an inverted U-shaped cross section perpendicular to a longitudinal direction along the tube axis and includes cutout portions and the nail portions, the cutout portions being each formed by cutting out the cover upward from a lower end edge of each of both side walls of the cover and being arranged at a predetermined pitch along the longitudinal direction, the nail portions being each formed between an adjacent cutout portions; and
a width of each of the cutout portions along the longitudinal direction at the lower end edge of each of the side walls is larger than a width of each of the nail portions.

2. The spraying tube device according to claim 1, wherein the uniformizing structure is constituted by a depression-projection portion formed on a surface of the spraying tube and configured to cause the spray solution to spread in a direction parallel to the tube axis direction.

3. The spraying tube device according to claim 1, wherein the width of the cutout portion at the lower end edge is two to six times the width of the nail portion.

4. The spraying tube device according to claim 1, wherein:
the cutout portion gradually increases in width as it extends downward; and
a depth of the cutout portion in a direction perpendicular to the lower end edge is 0.5 to 1.2 times the width of the cutout portion at the lower end edge.

5. A heat exchanger comprising:
the spraying tube device according to claim 4, and
a heat-transfer tube having an outer surface configured to receive the spray solution dropped from the uniformizing structure, the heat-transfer tube being configured to perform heat exchange between the spray solution and another fluid flowing through an inside of the heat-transfer tube.

6. A heat exchanger comprising:
the spraying tube device according to claim 2, and
a heat-transfer tube having an outer surface configured to receive the spray solution dropped from the uniformizing structure, the heat-transfer tube being configured to perform heat exchange between the spray solution and another fluid flowing through an inside of the heat-transfer tube.

7. The spraying tube device according to claim 1, wherein the uniformizing structure is arranged at a lower portion of the spraying tube and includes a plurality of fins arranged along the tube axis direction and facing downward.

8. A heat exchanger comprising:
the spraying tube device according to claim 1, and
a heat-transfer tube having an outer surface configured to receive the spray solution dropped from the uniformizing structure, the heat-transfer tube being configured to perform heat exchange between the spray solution and another fluid flowing through an inside of the heat-transfer tube.

9. A heat exchanger comprising:
the spraying tube device according to claim 3, and
a heat-transfer tube having an outer surface configured to receive the spray solution dropped from the uniformizing structure, the heat-transfer tube being configured to perform heat exchange between the spray solution and another fluid flowing through an inside of the heat-transfer tube.

10. The spraying tube device according to claim 7, wherein:
the fins are lined up in two rows parallel to the tube axis direction;
the fins are arranged at a constant pitch; and
one row of the fins and the other row of the fins are shifted from each other by a half pitch along the tube axis direction.

11. A heat exchanger comprising:
the spraying tube device according to claim 10; and
a single heat-transfer tube having an outer surface configured to receive the spray solution dropped from the fins lined up in two rows, the single heat-transfer tube being configured to perform heat exchange between the spray solution and another fluid flowing through an inside of the single heat-transfer tube.

12. A heat exchanger comprising:
the spraying tube device according to claim 10, and
a heat-transfer tube having an outer surface configured to receive the spray solution dropped from the uniformizing structure, the heat-transfer tube being configured to perform heat exchange between the spray solution and another fluid flowing through an inside of the heat-transfer tube.

13. The spraying tube device according to claim 1, wherein the uniformizing structure is a spreading pipe arranged at a lower portion of the spraying tube in parallel with the spraying tube and including depressions and projections on a surface of the spreading pipe, the depressions and projections causing the spray solution to spread in a direction parallel to the tube axis direction.

14. A heat exchanger comprising:

the spraying tube device according to claim 7, and a heat-transfer tube having an outer surface configured to receive the spray solution dropped from the uniformizing structure, the heat-transfer tube being configured to perform heat exchange between the spray solution and another fluid flowing through an inside of the heat-transfer tube.

15. A heat exchanger comprising:

the spraying tube device according to claim 13, and a heat-transfer tube having an outer surface configured to receive the spray solution dropped from the uniformizing structure, the heat-transfer tube being configured to perform heat exchange between the spray solution and another fluid flowing through an inside of the heat-transfer tube.

16. The spraying tube device according to claim 1, wherein a vertical line passing through a center of the spraying tube passes through each of the plurality of ejection holes arranged at the top most portion of the spraying tube along the tube axis.

17. The spraying tube device according to claim 1, wherein the cover is further configured to cause spray solution to flow downward on an inner surface of a side of the cover to gather the spray solution at tip ends of the nail portions.

* * * * *